US007721428B2

(12) United States Patent
Stoving et al.

(10) Patent No.: US 7,721,428 B2
(45) Date of Patent: May 25, 2010

(54) METHOD FOR MAKING AN ELECTRODE ASSEMBLY

(75) Inventors: Paul N. Stoving, Oak Creek, WI (US); E. Fred Bestel, West Allis, WI (US)

(73) Assignee: Cooper Technologies Company, Houston, TX (US)

( * ) Notice: Subject to any disclaimer, the term of this patent is extended or adjusted under 35 U.S.C. 154(b) by 572 days.

(21) Appl. No.: 11/234,215

(22) Filed: Sep. 26, 2005

(65) Prior Publication Data

US 2006/0016787 A1 Jan. 26, 2006

Related U.S. Application Data

(62) Division of application No. 10/370,102, filed on Feb. 21, 2003, now Pat. No. 6,965,089.

(51) Int. Cl.
*H01R 43/16* (2006.01)

(52) U.S. Cl. ..... 29/874; 29/842; 29/844; 29/876; 218/118; 218/128; 218/129; 218/130; 218/142

(58) Field of Classification Search ..... 29/874, 29/842, 844, 845, 876, 881, 904; 218/118, 218/123, 128, 130, 42, 129, 142
See application file for complete search history.

(56) References Cited

U.S. PATENT DOCUMENTS 3,469,050 A * 9/1969 Robinson et al. ..... 218/42
4,032,737 A 6/1977 Huhse et al.
4,071,727 A 1/1978 Crouch et al.
4,532,391 A 7/1985 Bernt
4,704,506 A 11/1987 Kurosawa et al.
4,839,481 A 6/1989 Nash et al.
4,871,888 A 10/1989 Bestel
4,982,059 A 1/1991 Bestel
5,004,877 A 4/1991 Yin
5,099,093 A 3/1992 Schels et al.
5,252,913 A 10/1993 Falkowski et al.
5,612,523 A 3/1997 Hakamata et al.
5,777,287 A 7/1998 Mayo
5,793,008 A 8/1998 Mayo et al.
5,804,788 A 9/1998 Smith (Continued)

FOREIGN PATENT DOCUMENTS

EP 0 849 751 6/1998

(Continued)

OTHER PUBLICATIONS

Holec HH Vacuum Interrupters, "Taking Care of Your Power", 6 pages.

(Continued)

*Primary Examiner*—Thiem Phan
(74) *Attorney, Agent, or Firm*—Fish & Richardson P.C.

(57) ABSTRACT

An electrode assembly for use in a vacuum interrupter is made by joining a first side of a substantially disk-shaped structure to an end of a substantially cylindrical coil segment, and joining an electrical contact to a second side of the disk-shaped structure. The disk-shaped structure has a higher resistivity than a resistivity of the coil segment.

20 Claims, 13 Drawing Sheets

U.S. PATENT DOCUMENTS

| | | | |
|---|---|---|---|
| 6,163,002 | A | 12/2000 | Ahn et al. |
| 6,248,969 | B1 | 6/2001 | Komuro et al. |
| 6,479,779 | B1 | 11/2002 | Falkingham et al. |
| 6,686,552 | B2 | 2/2004 | Nishijima et al. |
| 2002/0043514 | A1 | 4/2002 | Kim, II |

FOREIGN PATENT DOCUMENTS

| | | |
|---|---|---|
| GB | 780 652 | 8/1957 |
| GB | 2338111 A | 12/1999 |

OTHER PUBLICATIONS

Supplementary Partial European Search Report (Application No./Patent No. 04712272.6—PCT/US2004004491), dated Apr. 25, 2007, 4 total pages.

Examination Report produced by the EPO in a related application, Application No. 04 712 272.6—2214, dated Feb. 11, 2008, 6 total pages.

Search Report for corresponding European Application No. 09174586.9-2214, mailed Dec. 23, 2009, 5 pages.

* cited by examiner

METHOD FOR MAKING AN ELECTRODE ASSEMBLY

CROSS REFERENCE TO RELATED APPLICATION

This application is a divisional of U.S. application Ser. No. 10/370,102, filed Feb. 21, 2003, now U.S. Pat. No. 6,965,089, which is incorporated herein by reference in its entirety.

TECHNICAL FIELD

This description relates to vacuum fault interrupters.

BACKGROUND

Conventional vacuum fault interrupters exist for the purpose of providing high voltage fault interruption. Such vacuum fault interrupters, which also may be referred to as "vacuum interrupters," generally include a stationary electrode assembly having an electrical contact, and a movable electrode assembly on a common longitudinal axis with respect to the stationary electrode assembly and having its own electrical contact. The movable electrode assembly generally moves along the common longitudinal axis such that the electrical contacts come into and out of contact with one another. In this way, vacuum interrupters placed in a current path can be used to interrupt extremely high current, and thereby prevent damage to an external circuit.

SUMMARY

In one general aspect, a vacuum interrupter includes a first electrode assembly and a second electrode assembly. The second electrode assembly is on a common longitudinal axis with respect to the first electrode assembly, and is movable along the common longitudinal axis. At least one of the first electrode assembly and the second electrode assembly includes an annular contact support structure having an outer diameter, an inner diameter, and an end portion having an increased inner diameter, as well as an electrical contact that is connected to the end portion of the annular contact support structure.

Implementations may include one or more of the following features. For example, the increased inner diameter may be defined by a counter-bore at the end portion of the annular contact support structure. The counter-bore may form a substantially flat-bottomed recess at a mouth of the annular contact support structure. Further, the electrical contact may include a substantially cylindrical first portion disposed outside of both the counter-bore between the contact support structure and a substantially cylindrical second portion disposed within the counter-bore. Also, the second portion of the electrical contact may fit within and contact an inner surface of the counter-bore. Alternatively, the outer diameter of the annular contact support structure may be substantially equal to a diameter across a planar cross-section of the first portion of the electrical contact.

The annular contact support structure may be a copper coil segment having slots.

A substantially ring-shaped structure may be disposed between the annular contact support structure and the electrical contact. Further, the ring-shaped structure may have an outer portion located outside the counter-bore, and an inner portion located inside the counter-bore.

The outer portion of the ring-shaped structure may have a first diameter substantially equal to an outer diameter of the annular contact support structure and the first portion of the electrical contact. Alternatively, the inner portion of the ring-shaped structure may fit within and contact an inner surface of the counter-bore. Also, the second portion of the electrical contact may be within the inner diameter of the annular contact support structure and not in contact with a surface of the annular contact support structure.

A resistivity of the ring-shaped structure may be higher than a resistivity of the contact support structure and of the electrical contact, and the ring-shaped structure may be primarily composed of stainless steel. Further, the stainless steel may be substantially non-magnetic stainless steel.

In another general aspect, an electrode assembly for use in a vacuum interrupter includes an annular coil segment having an outer diameter, an inner diameter, and an end portion having an increased inner diameter. The electrode assembly also includes an electrical contact connected to the end portion of the annular coil segment.

Implementations may include one or more of the following features. For example, the increased inner diameter of the annular coil segment may be defined by a substantially flat-bottomed recess at a mouth of the annular coil segment. The electrical contact may have a substantially cylindrical first portion outside of the recess and a substantially cylindrical second portion inside of the recess. The first portion of the electrical contact may have an outer contact diameter that is substantially equal to the outer diameter of the annular coil segment.

The electrode assembly may also include a substantially disk-shaped structure disposed between the coil segment and the electrical contact. The disk-shaped structure may have an outer portion located outside the recess and an inner portion located inside the recess.

The outer portion of the disk-shaped structure may contact the first portion of the electrical contact, and the inner portion of the disk-shaped structure may contact a surface of the recess. Alternatively, the outer portion of the disk-shaped structure may have a first diameter substantially equal to the outer diameter of the annular coil segment and the outer contact diameter.

A resistivity of the disk-shaped structure may be higher than a resistivity of the coil segment.

In another general aspect, an electrode assembly for use in a vacuum interrupter is made by forming a recess into one end of a substantially cylindrical, conducting coil segment having a first diameter. A substantially cylindrical first portion of an electrical contact is also formed. The first portion has a second diameter substantially equal to the first diameter. A substantially cylindrical second portion of the electrical contact is also formed, and the secondary portion of the electrical contact is placed within the recess.

The recess may be formed by counter-boring the recess as a substantially flat-bottomed recess, and at least a first segment of a substantially ring-shaped structure may be inserted into the recess adjacent to the second portion of the electrical contact.

In inserting at least the first segment of the substantially ring-shaped structure, a second segment of the ring-shaped structure may be maintained outside of the recess and in contact with the first portion of the electrical contact. The second segment of the substantially ring-shaped structure may have a diameter substantially equal to that of the first diameter of the coil segment and the second diameter of the electrical contact.

The ring-shaped structure may have a resistivity higher than a resistivity of the coil segment and higher than a resistivity of the electrical contact. The coil segment may be a copper coil segment having slots.

In another general aspect, a vacuum interrupter includes a first electrode assembly and a second electrode assembly. The second electrode assembly is on a common longitudinal axis with respect to the first electrode assembly, and is movable along the common longitudinal axis. At least one of the first electrode assembly and the second electrode assembly includes a cylindrical contact support structure having a first resistivity and an annular structure having a second resistivity higher than the first resistivity. The annular structure is disposed in contact with the cylindrical contact support structure and is aligned along the common longitudinal axis with the cylindrical contact support structure. A cylindrical electrical contact is aligned with the annular structure along the common longitudinal axis and is disposed in contact with the annular structure.

Implementations may include one or more of the following features. For example, the electrical contact may have a first portion having a first diameter and a second portion having a second diameter smaller than the first diameter. The annular structure may encircle the second portion and may have a diameter substantially equal to the first diameter.

The contact support structure may have a counter-bore formed into one end thereof, with the counter-bore forming a flat-bottomed recess into a mouth of the end of the contact support structure. The annular structure may have an outer portion located outside of the counter-bore and an inner portion located inside the counter-bore.

Further, the electrical contact may have a first portion having a first diameter and a second portion having a second diameter smaller than the first diameter. The second portion of the electrical contact may be located inside the counter-bore and in contact with the inner portion of the annular structure. Also, the first diameter of the electrical contact, the outer diameter of the outer portion of the annular structure, and an outer diameter of the contact support structure may be substantially equal.

The outer portion and the inner portion of the annular structure may be in contact with a surface of the contact support structure. Additionally, the contact support structure may have an interior hollow portion, and the second portion of the electrical contact may be within the interior hollow portion and not in contact with the surface of the contact support structure.

The contact support structure may be a copper coil segment into which slots are machined. The annular structure may be primarily composed of stainless steel, such as substantially non-magnetic stainless steel.

In another general aspect, an electrode assembly for use in a vacuum interrupter includes a substantially cylindrical coil segment having a first resistivity and a substantially ring-shaped structure disposed in contact with the coil segment and having a second resistivity higher than the first resistivity. An electrical contact is disposed in contact with the ring-shaped structure so as to sandwich the ring-shaped structure between the coil segment and the electrical contact.

Implementations may include one or more of the following features. For example, the electrical contact may have a first portion having a first diameter and a second portion having a second diameter smaller than the first diameter. The ring-shaped structure may encircle the second portion and may have a ring diameter substantially equal to the first diameter.

The coil segment may have a substantially flat-bottomed recess formed into a mouth of one end thereof. The ring-shaped structure may have an outer portion located outside of the recess and an inner portion located inside the recess. Also, the electrical contact may have a first portion having a first diameter and a second portion having a second diameter smaller than the first diameter. The second portion of the electrical contact may be located inside the recess and in contact with the inner portion of the ring-shaped structure.

The first diameter of the electrical contact, the outer diameter of the ring-shaped structure, and an outer diameter of the coil segment may be substantially equal. The outer portion and the inner portion of the ring-shaped structure may be in contact with a surface of the coil segment. Also, the coil segment may have an interior hollow portion. The second portion of the electrical contact may be within the interior hollow portion and not in contact with the surface of the coil segment.

In another general aspect, an electrode assembly for use in a vacuum interrupter may be made by joining a first side of a substantially disk-shaped structure to an end of a substantially cylindrical coil segment. The disk-shaped structure has a higher resistivity than a resistivity of the coil segment. An electrical contact is joined to a second side of the disk-shaped structure.

Implementations may include one or more of the following features. For example, the coil segment may include an interior hollow portion.

When joining the first side of the disk-shaped structure, a substantially flat-mouthed recess may be counter-bored into the coil segment, and an inner portion of the disk-shaped structure having an inner diameter may be formed. Further, an outer portion of the disk-shaped structure having an outer diameter larger than the inner diameter also may be formed. Also, the inner portion may be inserted into the recess such that the inner portion and the outer portion are in contact with a surface of the coil segment.

Also, a first portion of the electrical contact may be formed having a first diameter, and a second portion of the electrical contact may be formed having a second diameter smaller than the first diameter. The second portion of the electrical contact may be inserted into the recess and the hollow portion such that the second portion of the electrical contact is within the inner portion of the disk-shaped structure and not in contact with the surface of the coil segment.

The outer diameter of the disk-shaped structure, the first diameter of the first portion of the electrical contact, and a diameter of the coil segment may be substantially equal.

The details of one or more implementations are set forth in the accompanying drawings and the description below. Other features will be apparent from the description and drawings, and from the claims.

DETAILED DESCRIPTION

Figure 1:
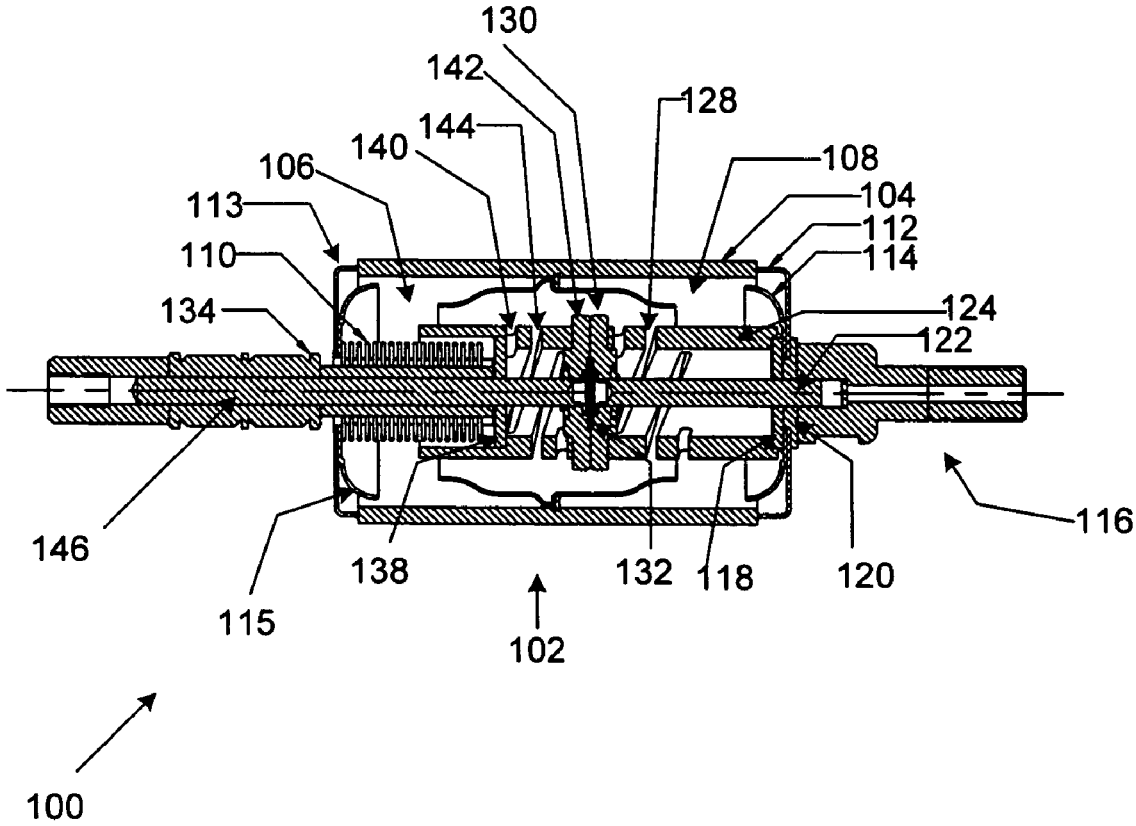
FIG. 1 is a cutaway side view of a vacuum interrupter.

FIG. 1 demonstrates a vacuum interrupter 100 that includes a vacuum vessel 102. Vacuum vessel 102 is designed to maintain an integrity of a vacuum seal with respect to components enclosed therein. Part of vacuum vessel 102 is a ceramic material 104, which is generally cylindrical in shape. Vacuum vessel 102, including ceramic material 104, contains a movable electrode structure 106, which, as described below, is operable to move toward and away from a stationary electrode structure 108, to thereby permit or prevent a current flow through the vacuum interrupter 100. A bellows 110 within vacuum vessel 102 is composed of a convoluted, flexible material, and is used to maintain the integrity of the vacuum vessel 102 during a movement of the movable electrode structure 106 toward or away from the stationary electrode structure 108, as discussed in more detail below.

The stationary electrode structure 108 further includes a tubular coil conductor 124 in which slits 128 are machined, and an electrical contact 130. The electrical contact 130 and tubular coil conductor 124 are mechanically strengthened by a structural support rod 122. An external conductive rod 116 is attached to the structural support rod 122 and to conductor discs 118 and 120.

The movable electrode structure 106 has many functionally-similar parts as the stationary electrode structure 108. In particular, structure 106 includes a tubular coil conductor 140 in which slits 144 are machined, and an electrical contact 142. Structure 106 also includes a conductor disc 138 attached to the bellows 110 and to the movable coil conductor 140 such that the electrical contact 142 may be moved into and out of contact with the electrical contact 130. The movable electrode structure 106 is mechanically strengthened by support rod 146, which extends out of the vacuum vessel 102 and is attached to a moving rod 134. The moving rod 134 and the support rod 146 serve as a conductive external connection point between the vacuum interrupter and an external circuit, as well as a mechanical connection point for actuation of the vacuum interrupter.

A vacuum seal at each end of the ceramic portion 104 is provided by metal end caps 112 and 113, which are brazed to a metallized surface on the ceramic. Along with the end cap 112, an end shield 114 protects the integrity of the vacuum interrupter, and is attached between conductor discs 118 and 120. Similarly, an end shield 115 is positioned between bellows 110 and end cap 113.

In the vacuum fault interrupter of FIG. 1, current may flow, for example, from coil conductor 124, electrical contact 130, and electrical contact 142 to coil conductor 140, so that, with respect to contacts 130 and 142, the current may flow straight through from the ends of slots 128 and 144. This current becomes an arc current when electrode structure 106 is separated from electrode structure 108.

In FIG. 1, slots 128 and 144 that are cut into copper coil segments 124 and 140 generate a magnetic field parallel to the common longitudinal axis of the electrode structures (an axial magnetic field). The presence of the uniform axial magnetic field causes a diffuse arc between the electrical contacts when separated, which advantageously produces low electrical contact wear and is easy to interrupt.

Figure 2:
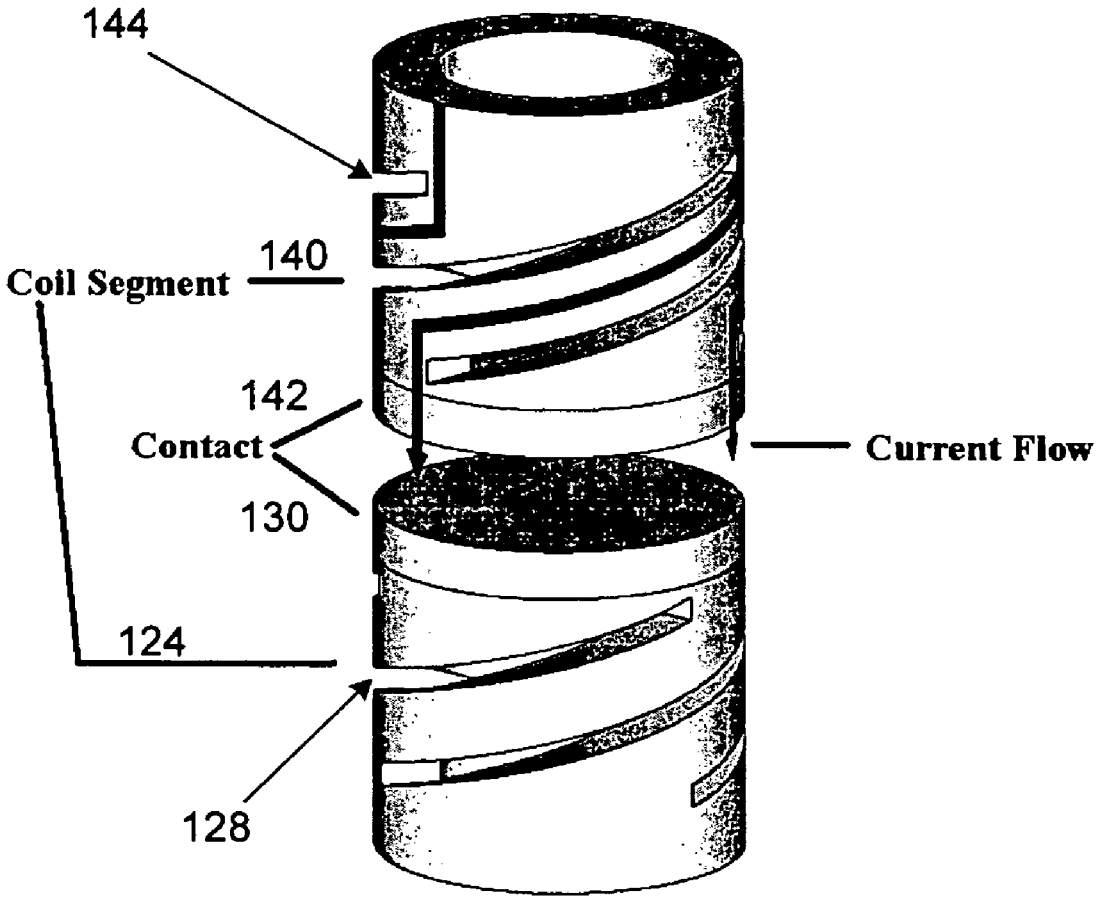
FIG. 2 is a perspective view of coil segments of the vacuum interrupter of FIG. 1.

FIG. 2 illustrates coil segments 124 and 140 and their respective slots 128 and 144. As shown in FIG. 2, current flow between the coil segments generally takes the shortest possible path (i.e., current enters contact 142 after the end of each slot 144). This results from the flush end of coil segment 140 being connected directly to contact 142. As a result of this current flow, magnetic flux (and thereby a magnitude of the corresponding magnetic field) is generally reduced. This reduction in the axial magnetic field reduces an ability of the field to keep the arc diffuse and uniform between the contacts, and is therefore undesirable.

Figure 3:
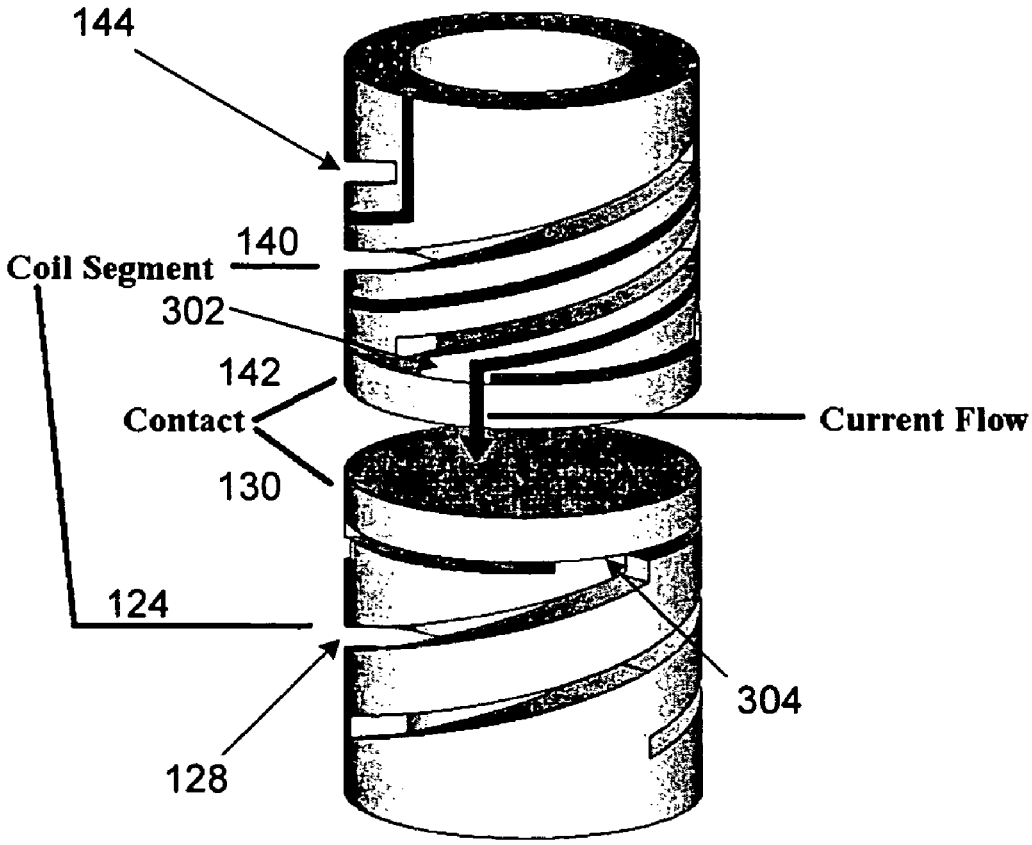
FIG. 3 is a perspective view illustrating a technique for increasing a current path between coil segments and electrical contacts of the vacuum interrupter of FIG. 1.

FIG. 3 demonstrates a technique for increasing a current path between the coil segments and the electrical contacts. In FIG. 3, metal footings or clips 302 and 304 are placed at the ends of the coil segments 124 and 140. The increased length of the current path leads to a higher magnetic field, but also results in difficulty in aligning the footing segment 302 and 304. Moreover, although the magnitude of the axial magnetic field is increased by the technique of FIG. 3, the fact that the current enters contacts 142 and 130 in concentrated regions may lead to localized heating effects and/or a less uniform axial magnetic field.

Figure 4:
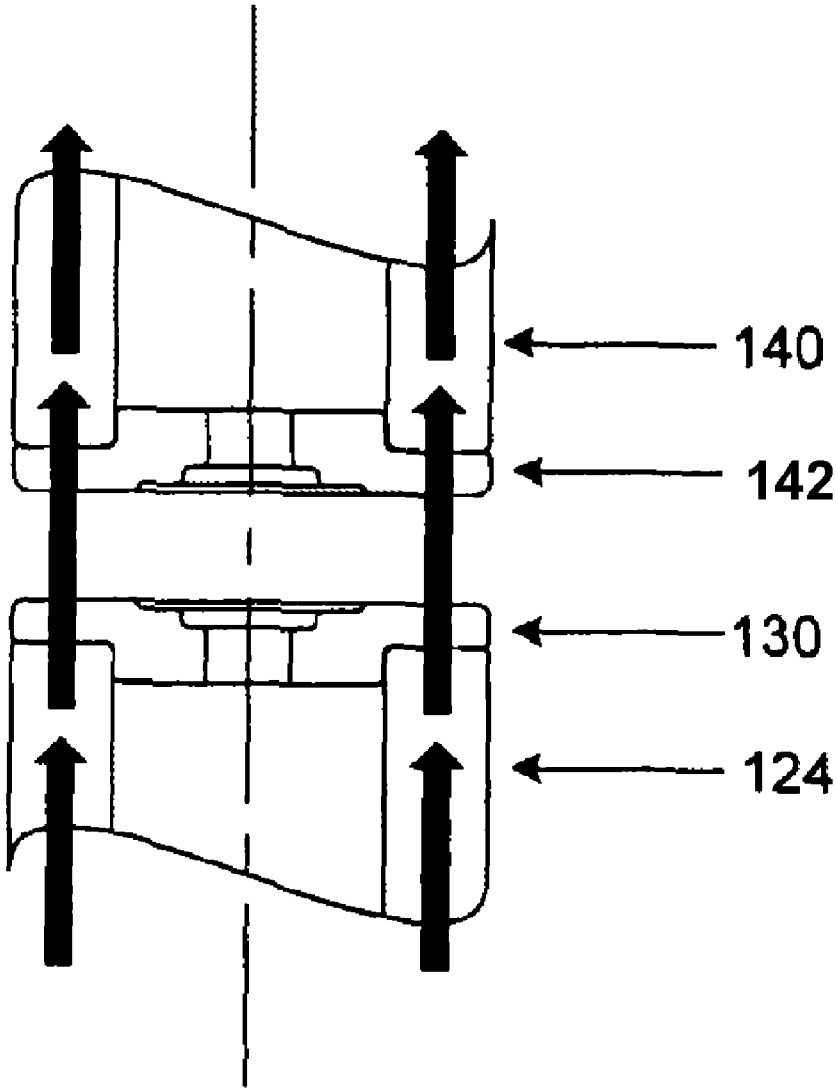
FIG. 4 is a block diagram illustrating current flow in the vacuum interrupter of FIG. 1.

FIG. 4 demonstrates a typical flow of current through vacuum fault interrupter of FIG. 1. As shown in FIG. 4, current flow is generally uniform through the portions of coil segments 124 and 140 which contact electrical contacts 130 and 142, respectively. Coil segments 124 and 140 are typically composed of a copper tube. The copper tube should ensure that a cross section between slots 128 and 144 (note that slots 128 and 144, shown in FIG. 1, are not explicitly illustrated in FIG. 4) is sufficient to carry high magnitude fault currents traversing the vacuum fault interrupter. As a result, particularly for high-magnitude fault currents, very thick or "heavy-walled" copper tubes may be employed.

However, such heavy-walled copper tubes are generally not ideal for ensuring desirable current flow, that is, current flow which is concentrated as much and as close as possible to an outside diameter of the tube. This is due to the magnitude of the magnetic field being determined by an amount of the current enclosing the field in the copper tubes. That is, since the current is flowing through the walls of the tube, there is less current enclosing the magnetic field at an edge of the tube than there is within an inner diameter of the tube. As a result, the field peaks at a center of the tube, and decreases to zero at the outer perimeter of the walls. In a thin-walled tube, the magnetic field peak is lower and the rate of drop-off towards the outside diameter is less. Also, since the inside diameter is closer to the outside diameter (and is thus larger) in a thin-walled tube, this drop-off occurs closer to the outside diameter of the tube, ensuring a larger area with a uniform magnetic field. Uniformity of the magnetic field is thus generally inversely related to the thickness of the walls of the tube.

Figure 5:
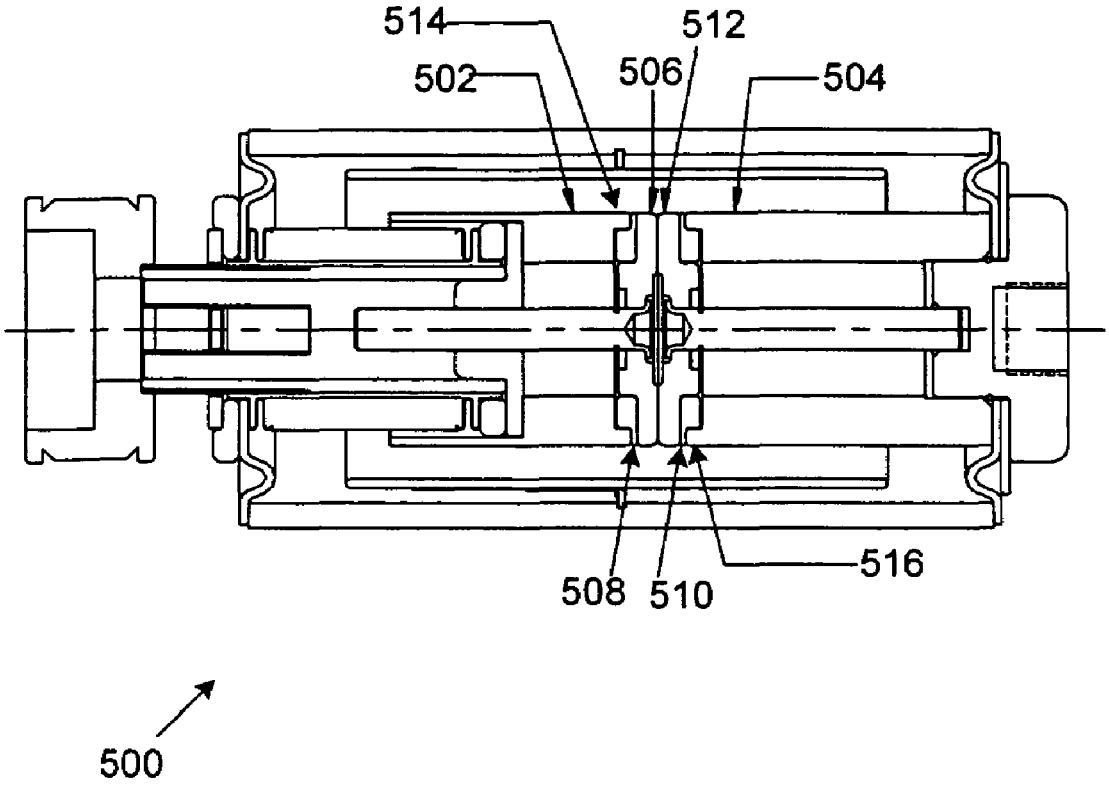
FIG. 5 is a cutaway side view of a vacuum interrupter.

FIG. 5 demonstrates a vacuum fault interrupter 500 that is similar in structure to the fault interrupter 100 of FIG. 1. Note that portions of FIG. 5 not explicitly discussed in the following discussion or above with respect to FIG. 1 are discussed in more detail below with respect to FIGS. 10 and 12. In FIG. 5, a stainless steel ring 508 is placed between coil segment 502 and contact 506 (which correspond to coil segment 140 and contact 142). Similarly, a stainless steel ring is also placed between coil segments 504 and contact 512.

Coil segment 502 includes a small counterbore that produces a longitudinal protrusion 514 that extends from the end of the coil segment around the perimeter of the coil segment. Similarly, coil segment 504 has a counterbore that produces a longitudinal protrusion 516 at the end of that coil segment. Thus, each coil has a constant outer diameter and an inner diameter that increases at the protrusion. Techniques other than counterboring may be used to produce the same results. For example, the coil segments may be cast or forged using a form that defines the protrusions.

Stainless steel rings 508 and 510 each have a volume resistivity higher than those of their respective coil segments and the electrical contacts, such that current flow through the rings is uniformly spread through the copper at the end of the coil segments, and uniformly enters the contacts. Stainless steel rings 508 and 510 may be composed of, for example, a non-magnetic stainless steel, such as AISI 304.

Because the current does not enter the contacts immediately at the end of the slots in the electrode structure, a longer current path is created. As a result, a magnitude of the axial magnetic field is increased. Also, because of the uniform spreading of the current upon entering the contacts, localized heating at the contacts is reduced, and a uniformity of the axial magnetic field is correspondingly improved. Finally, the presence of the relatively high resistivity ring also serves to reduce any losses in the axial magnetic field which may result from the presence of eddy currents. For example, in the vacuum fault interrupter 100 of FIG. 1, eddy currents may momentarily travel around coil segment 124, and momentarily skip around slot 128 (via contact 130) and back into coil segment 124; in the vacuum fault interrupter 500 of FIG. 5, the high-resistivity ring(s) 508/510 prevent this behavior. Additionally, the presence of the high-resistivity (impedance) ring(s) 508/510 in FIG. 5 reduces a conductive cross section available to eddy currents, by taking up space that is filled by the contacts 130 and 142 and/or the coil segments 124 and 140 in FIG. 1.

Because the above-recited features result from the relatively high resistivity of the stainless steel rings 508 and 510, other materials with similarly high resistivities may also be used to obtain the advantages. For example, certain copper-chrome or copper-nickel alloys (such as Monel) could also be used. Additionally, another way to increase an impedance (although not a resistivity) presented to the current is to increase a diameter of the counter bore (i.e., use a narrow cross section on the end of the coil sections 108 and 140).

Additionally, protrusions 514 and 516 force the flow of current to an outside diameter of the coil segments and contacts. As a result, despite the use of heavy-walled copper in constructing coil segments 502 and 504, a uniform axial magnetic field may nevertheless be obtained.

Figure 6:
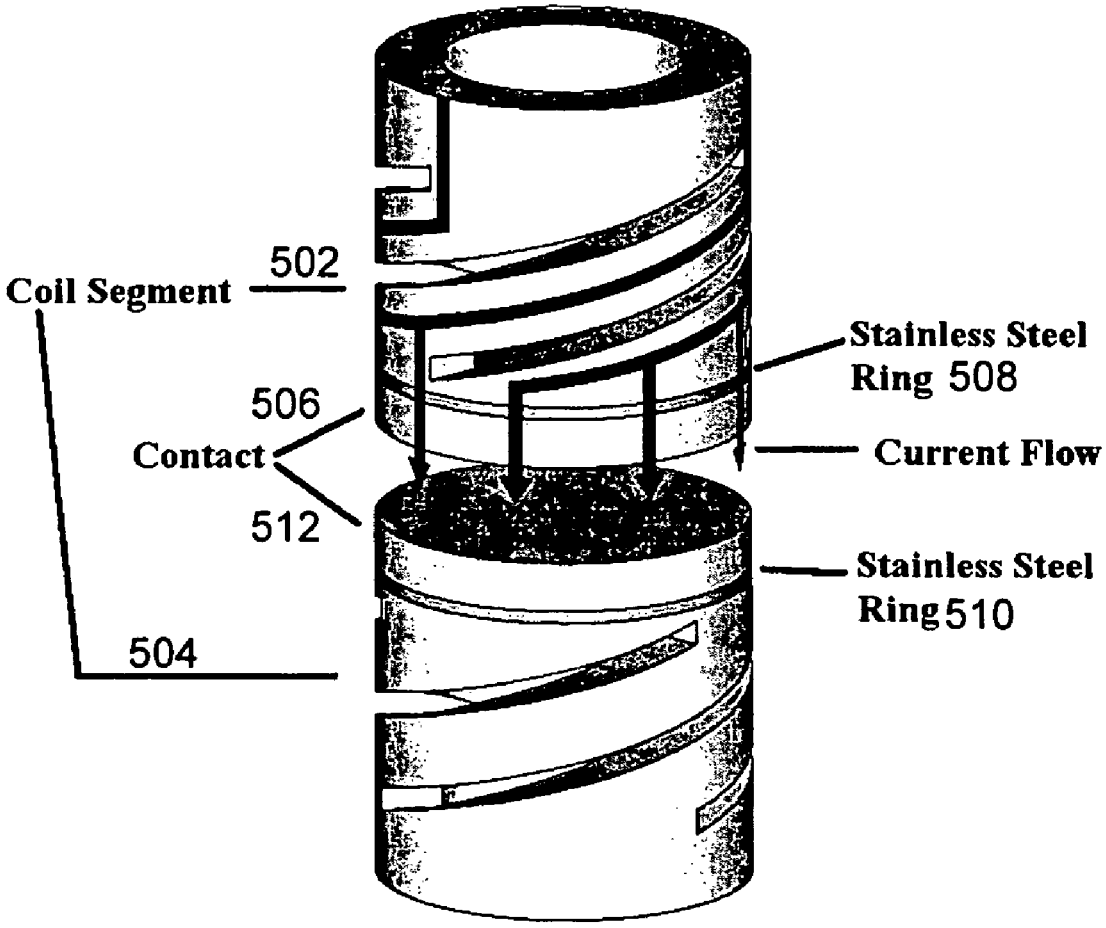
FIG. 6 is a perspective view illustrating current flow through the vacuum fault interrupter of FIG. 5.
Figure 7:
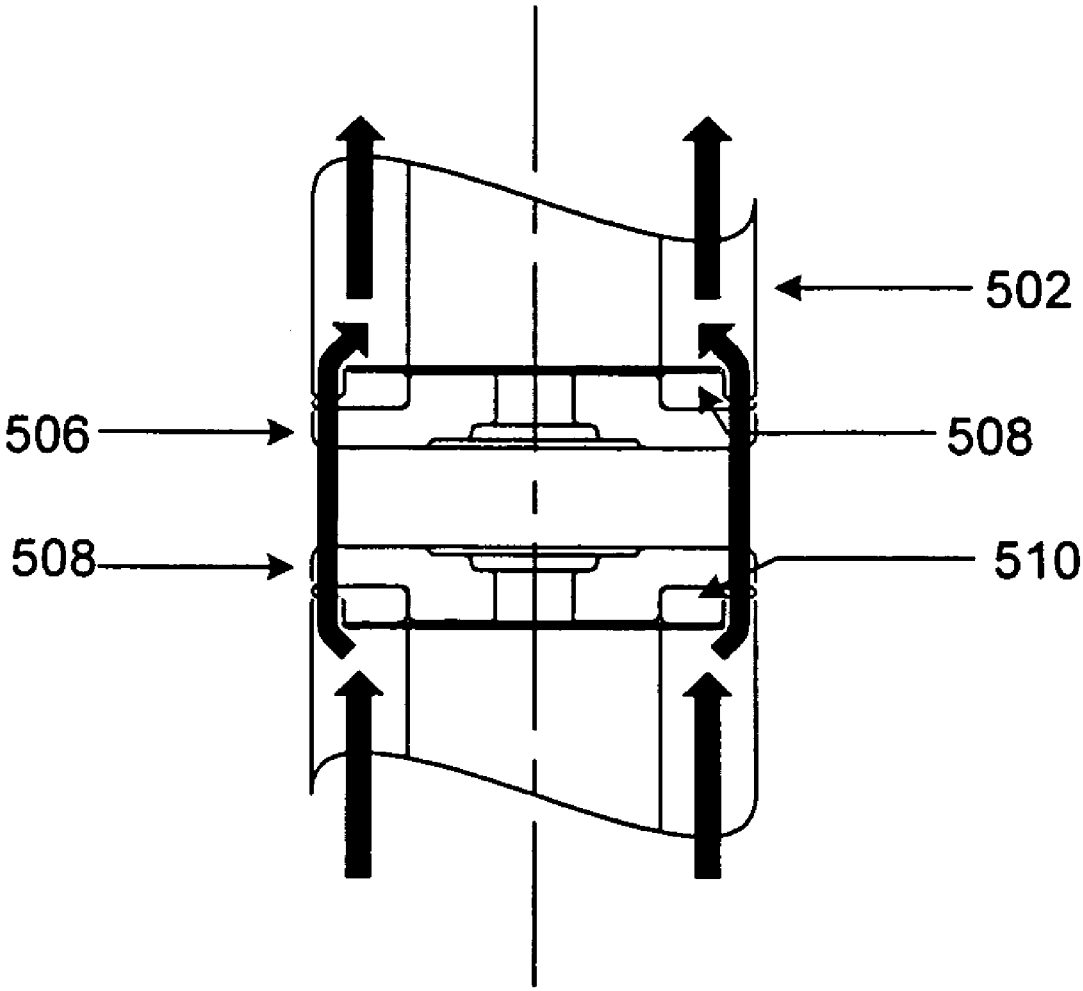
FIG. 7 is a block diagram illustrating current flow through the vacuum interrupter of FIG. 5.

FIG. 6 demonstrates a current flow through the vacuum fault interrupter of FIG. 5. In FIG. 6, it should be understood that current flow occurs uniformly between the coil segments due to the presence of steel rings 508 and 510. FIG. 7 demonstrates a cross section of current flow through the vacuum interrupter of FIG. 5. As shown in FIG. 7, current flow is forced to an outside diameter of coil segments 124 and 140, which increases the uniformity of an axial magnetic field between the electrodes.

Figure 8A:
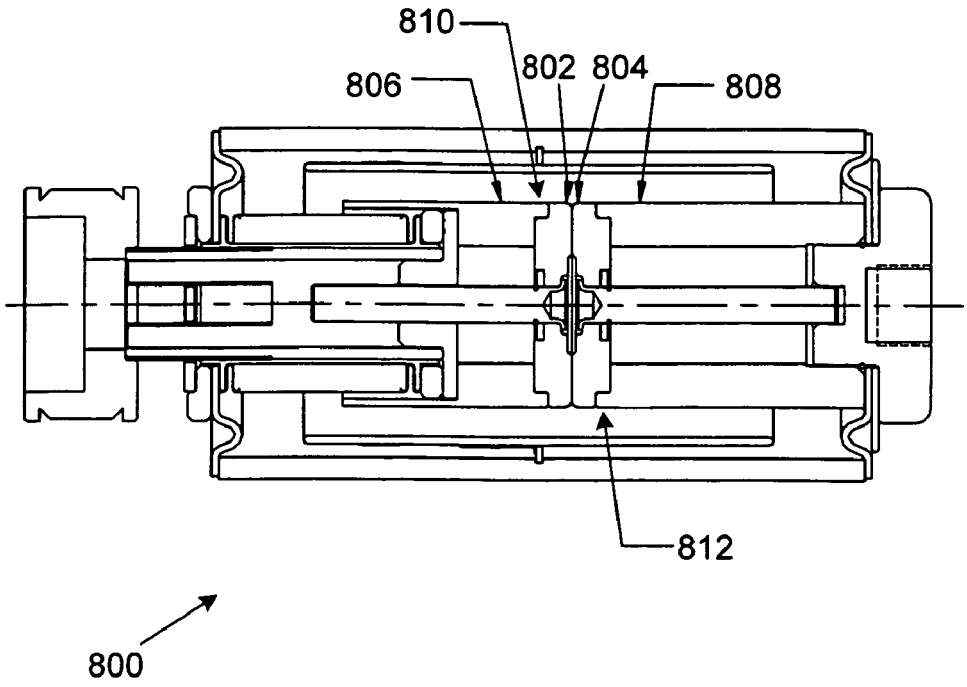
FIG. 8A is a cutaway side view of a vacuum interrupter.

FIG. 8A demonstrates a vacuum interrupter 800 that is similar to the vacuum interrupter 500 of FIG. 5. Each of coil segments 806 and 808 includes a counterbore and a corresponding ring-shaped protrusion 810 or 812. However, stainless steel rings like the rings 508 and 510 are not included.

Figure 8B:
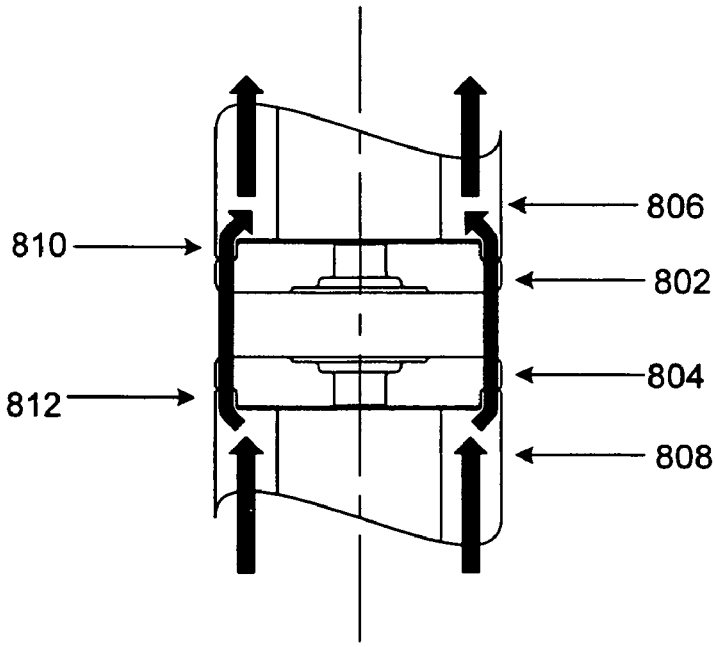
FIG. 8B is a block diagram illustrating current flow through the vacuum interrupter of FIG. 8A.

FIG. 8B illustrates current flow in the implementation of FIG. 8A. In FIG. 8B, as in FIGS. 5-7, current is forced to an outside perimeter of coil segment 808 by virtue of portions 810 and 812. This is true aside from the fact that no stainless steel rings or other impedance is placed between coil segments 806, 808 and electrical contacts 802, 804, respectively. In FIGS. 8A and 8B, it should be apparent that contacts 802 and 804 are shaped differently than contacts 506 and 512. Specifically, contacts 802 and 804 each have a portion within the counterbore of coil segments 806 and 808 that extends throughout essentially the entire diameter of the counterbore, and has direct contact with all of the interior surfaces at the ends of the coil segments 806 and 808, including those of ring-shaped protrusions 810 and 812.

Figure 9A:
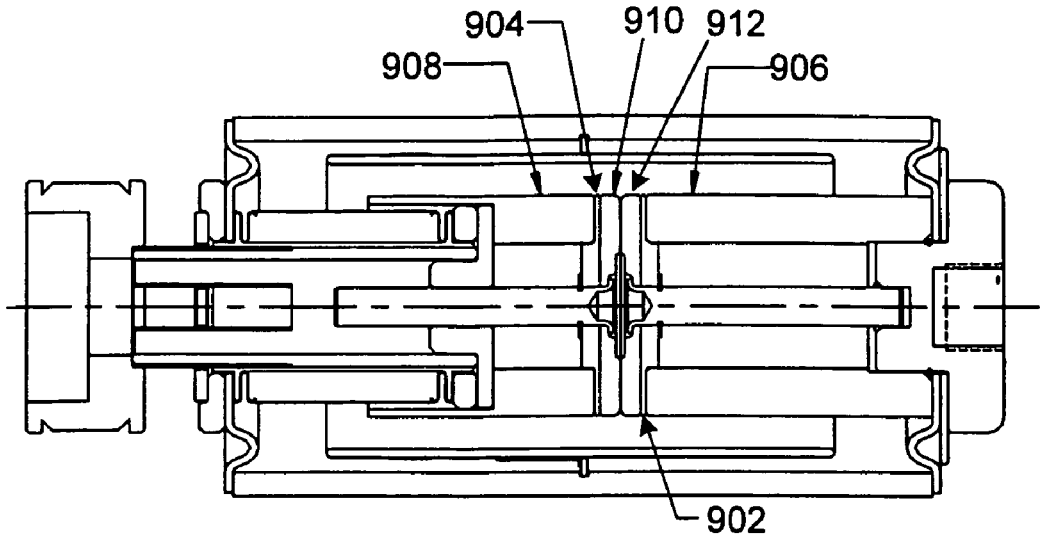
FIG. 9A is a cutaway side view of a vacuum interrupter.

Conversely, FIG. 9A demonstrates an implementation of the vacuum interrupter of FIG. 5 in which there is no counter bore in the coil segments 906 and 908. Rather, coil segments 906 and 908 have flush ends, against which steel rings or other high resistivity rings 902 and 904 are situated between the coil segments 906 and 908 and the contacts 912 and 910, respectively.

Figure 9B:
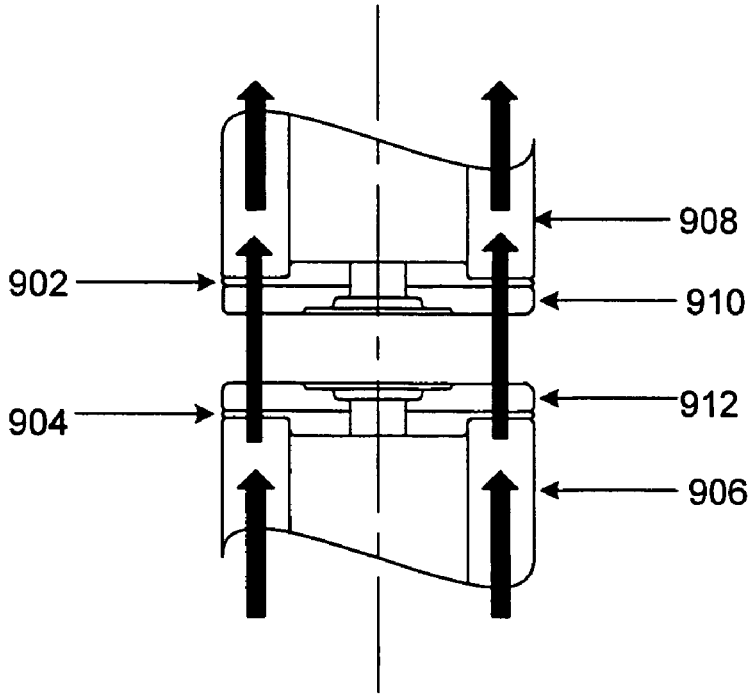
FIG. 9B is a block diagram illustrating current flow through the vacuum interrupter of FIG. 9A.

FIG. 9B illustrates current flow in the implementation of FIG. 9A. In FIG. 9B, current is dispersed by the presence of rings 902 and 904, and therefore travels evenly through contacts 910 and 912, as well as through coil segments 906 and 908. In this way, the current path is effectively lengthened, resulting in a higher axial magnetic field and less localized heating at the contacts 910 and 912.

Use of the vacuum interrupters of FIGS. 5, 8 and 9 is governed by particular needs of a user of the interrupter. For example, the assembly of the formation of FIGS. 8A and 8B may obviate any cost and assembly-related difficulties associated with rings 508 and 510. Conversely, machining of the coil segments 906 and 908 of the vacuum interrupter of FIGS. 9A and 9B may be eased by the nature of the flush end of the coil segments 906 and 908 with respect to steel rings 902 and 904.

Figure 10:
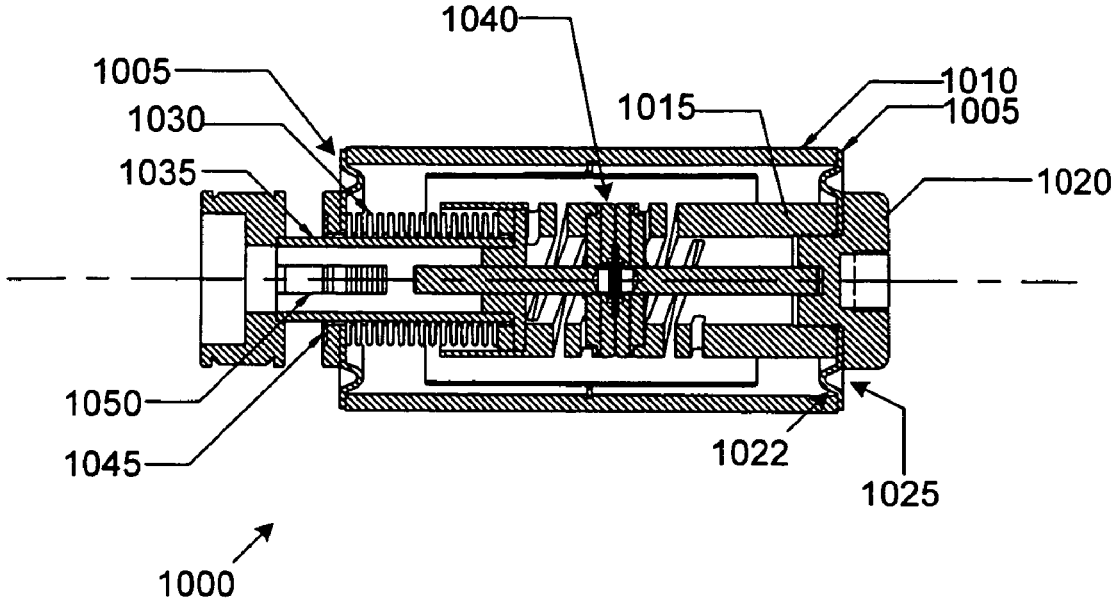
FIG. 10 is an alternate implementation of a vacuum interrupter.

FIG. 10 illustrates an alternate implementation of a vacuum interrupter 1000. In FIG. 10, an end cap 1005 serves to help maintain an integrity of a vacuum seal of vacuum interrupter 1000. End cap 1005 is attached to ceramic 1010, cylindrical structure 1015, and conductive segment 1020. In this implementation, conductive segment 1020 is a female-threaded connector for connecting to a male-threaded connector and thereby to an external circuit. Compared to external conductive rod 116 of FIG. 1, segment 1020 provides a more stable base upon which the vacuum interrupter of FIG. 10 may need to rest during an assembly of the vacuum interrupter.

Additionally, end cap 1005 includes a loop 1022 that provides several advantages. For example, in the vacuum interrupter of FIG. 1, end caps 112 and 113 are generally fixtured during assembly of the vacuum interrupter, and thereby held in place while being brazed to the metallized surface on ceramic 104. This is necessary since the brazing is a fluid process, and the end caps 112 and 113 might float out of position if not held in place by fixtures. Nonetheless, such fixtures are often elaborate and, particularly with respect to a level of cleanliness that must be preserved throughout the brazing process, extremely difficult to maintain. Moreover, such fixtures are often difficult to maintain mechanically as well, often loosening over time until they fail to secure their associated portions of the vacuum interrupter tightly enough to ensure functionality.

As the vacuum interrupter cools from the brazing cycle (approximately 700-800° C.), a difference in the coefficients of linear thermal expansion between ceramic 104 (approximately 6-8×$10^{-6}$ inches/inches° C.) and end cap 112 (approximately 1-2×$10^{-6}$ inches/inches° C.) may cause end cap 112 to bow inward, thereby changing the overall length of the vacuum interrupter. Moreover, the amount of this bowing tends to vary, making it difficult to predict a final length of a vacuum interrupter being assembled.

Additionally, end shield 114, which may be either attached to end cap 112 as shown in FIG. 1 or integral to end cap 112, serves to protect the triple joint (ceramic, metal, and vacuum) at each end of ceramic 104. Because the tip of end shield 114 has a relatively sharp point, end shield 114 tends to focus electrical stress (electric field), such that any burrs or discontinuities on the surface of end field 114 may cause a failure of the vacuum fault interrupter at high voltage.

In contrast, the rounded surface of the loop 1022 of the end cap 1005 in the vacuum interrupter of FIG. 10 produces a much lower electrical stress and thereby reduces the probability of a failure at high voltage. Furthermore, this loop acts as a radial spring that absorbs any differences in the coefficients of linear thermal expansion between the ceramic 1010 and metal end cap 1005. Since the end caps do not bow, the end length of the vacuum interrupter of FIG. 10 does not vary significantly. In anther example of an advantageous feature of the vacuum interrupter of FIG. 10, the loop-associated angles and radii leading to the loop from the outer flange surface (i.e., a flat area outside the loop) tend to be self aligning at braze temperature, so that elaborate fixturing is not necessary to hold the end cap in place until the end cap is brazed.

Figure 11A:
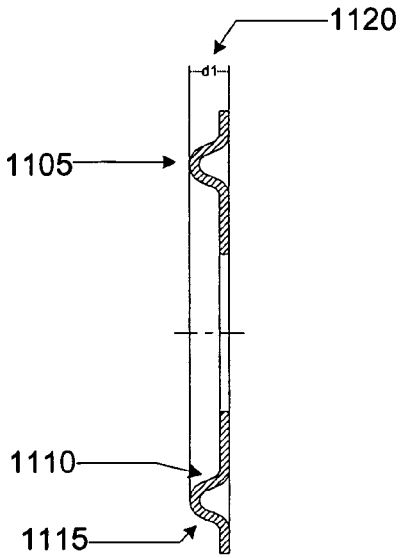
FIG. 11A is a sectional view of a first end cap for use with the vacuum interrupter of FIG. 10.
Figure 11B:
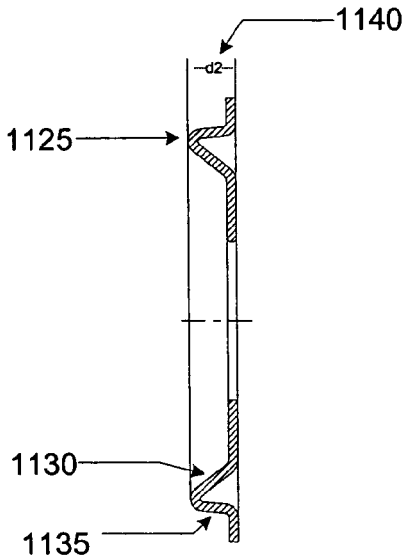
FIG. 11B is a sectional view of a second end cap for use with the vacuum interrupter of FIG. 10.
Figure 11C:
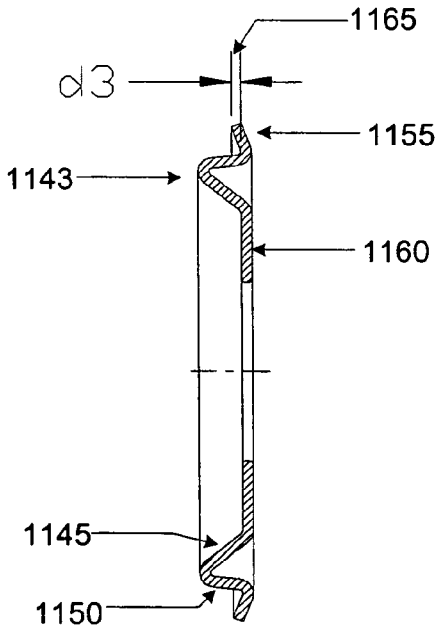
FIG. 11C is a sectional view of a third end cap for use with the vacuum interrupter of FIG. 10.

FIGS. 11A, 11B, and 11C illustrate three examples of loops that may be formed in the end caps 1005 of the vacuum interrupter of FIG. 10. In FIG. 11A, a loop 1105 is essentially perfectly rounded, so that portions 1110 and 1115 are substantially symmetrical, and define a distance "d1" 1120 that exists between a bottom of loop 1105 and a top plane of end cap 1005.

In FIG. 11B, a loop 1125 is less rounded and comes to a somewhat sharper point. In this case, portions 1130 and 1135 may be of different lengths, as shown. Also, a distance "d2" 1140 may be relatively larger than distance d1 1120. Increasing or decreasing the distance d1 1120 or d2 1140 may impact a spring constant of loop 1105 or 1125, respectively, as well as an amount of triple joint protection and shielding. Similarly, increasing or reducing a symmetry of loops 1105 and 1125 may also affect their respective spring constants, so that these factors may be adjusted as needed to obtain a desired result. Thus, as long as the loop does not form such a sharp point as to begin to act as an area of electric field concentration, thereby causing electrical discontinuities, a degree of concavity may be chosen by a designer in any manner thought to optimize the use of end cap 1005.

In FIG. 11C, a loop 1140 is similar to the loop 1125 of FIG. 11B, with respect to a shape of portions 1145 and 1150. However, in FIG. 11C, an outer portion 1155 (i.e., an outer sealing flange of the end cap 1005) is not completely co-planar with an inner portion 1160 of the end cap 1005, as is shown in FIGS. 11A and 11B. Rather, only a portion of the outer portion 1155 is co-planar with the inner portion 1160. A remaining portion of the outer portion 1155 tapers away from a plane of the inner portion 1160, to define a distance "d3" 1165, and thus forms the outer portion 1155 into a slightly conical shape. In practice, the distance d3 1165 may be, for example, approximately 0.001 inches to 0.010 inches, and may not be visible to the naked eye (in FIG. 11C, a magnitude of the distance d3 1165 with respect to a size of the end cap 1005 is exaggerated for the sake of illustration). Although a portion of the outer portion 1155 is co-planar with the inner portion 1160 in FIG. 11C, the outer portion 1155 could also be formed so as to have no portion that is co-planar with the inner portion 1160, regardless of whether the outer portion 1155 is tapered in the manner of FIG. 11C.

Referring again to FIG. 10, cover portions 1025 may optionally be used to cover an open area formed by the presence of the loop in end cap 1005. This cover may be useful in situations in which the vacuum interrupter of FIG. 10 is to be molded within a solid dielectric (e.g., an epoxy material). In this way, an air cavity is maintained within the concavity formed by the loop in end cap 1005, so that the advantageous compression of end cap 1005 discussed above may also be realized for absorbing stresses associated with solid dielectrics, i.e., molding stresses. In other situations, such as when the vacuum interrupter is encased in oil, cover portions 1025 may not be necessary.

As referred to above with respect to FIG. 1, a motion of a moving rod 134, and its associated electrical contact 142, is maintained with a bellows 110. While very flexible, bellows 110 may also be quite fragile. Thus, after the vacuum interrupter of FIG. 1 is brazed together, there must be assurance that the moving rod 134, and thus the bellows 110, are not twisted, as this would damage the bellows 110.

To help avoid damage to bellows 1030 of FIG. 10, a slot 1050 is formed in a tubular portion of moving rod 1035. A guide 1045 having a plurality of ears is affixed to the end cap 1005, and these ears ride in the slot 1050 in the moving rod 1035, which extends along moving rod 1035 into the vacuum interrupter, past the end cap 1005. FIG. 13 demonstrates a cross-section view of moving rod 1035 showing guide 1045 taken along sectional line 13-13 shown in FIG. 12. In FIG. 13, other elements of FIG. 12 are not shown, to thereby better illustrate the slotted nature of moving rod 1035 and guide 1045.

Figure 12:
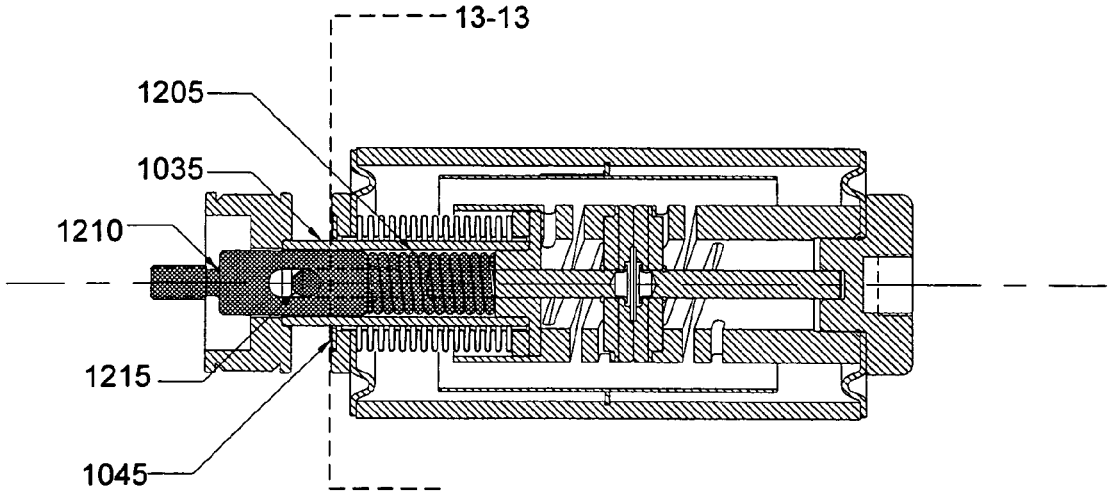
FIG. 12 is an alternate sectional view of the vacuum interrupter of FIG. 10.
Figure 13:
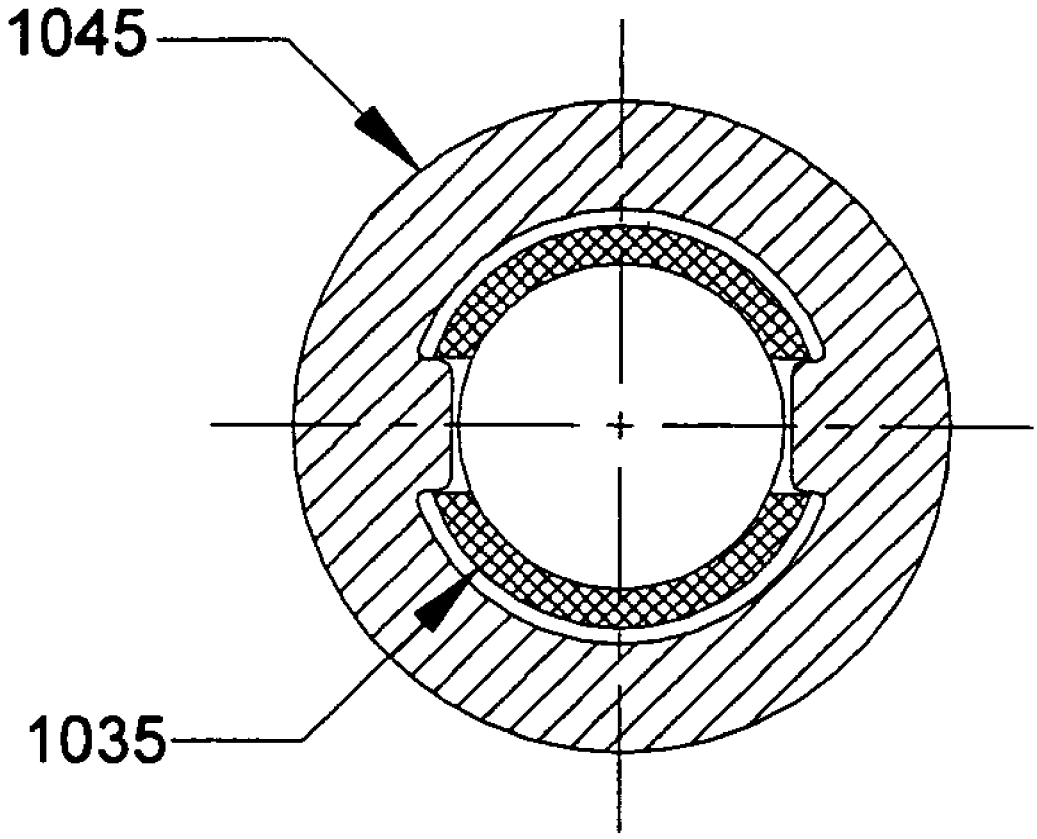
FIG. 13 is a cross-sectional view of the vacuum interrupter of FIG. 12 taken along section 13-13.

FIG. 12 illustrates the addition of a compression spring 1205 that is added and held in place via a spring holder 1210 that in turn is held in place by a roll pin 1215. The roll pin 1215 sits in slot 1050 (not seen in this figure). Actuation of the vacuum interrupter is transmitted through compression spring 1205. Through the assembly as described above and shown in FIGS. 10, 12, and 13, the moving rod 1035 is prevented from twisting and damaging the bellows during subsequent assembly operations, e.g., current exchange assembly or epoxy encapsulation, and little or no fixturing may be required to achieve this result.

A number of implementations have been described. Nevertheless, it will be understood that various modifications may be made. Accordingly, other implementations are within the scope of the following claims.

What is claimed is:

1. A method for making an electrode assembly for use in a vacuum interrupter, the method comprising:

forming an end portion at a perimeter of a substantially cylindrical coil segment;

joining a first side of a substantially disk-shaped structure to the end portion of the substantially cylindrical coil segment by contacting a contiguous surface at the end portion of the substantially cylindrical coil segment directly to the first side of the disk-shaped structure such that the first side of the disk-shaped structure is flush with the contiguous surface of the substantially cylindrical coil segment end, the disk-shaped structure having a higher volume resistivity than a volume resistivity of the substantially cylindrical coil segment; and joining an electrical contact a second side of the disk-shaped structure such that, once joined, the electrical contact and the disk shape structure share an outer periphery and substantially all of a current that flows between the substantially cylindrical coil segment and the electrical contact flows through the end portion.

2. The method of claim 1 wherein the substantially cylindrical coil segment includes an interior hollow portion.

3. The method of claim 1, wherein current flows between the substantially cylindrical coil segment and the electrical contact through the substantially disk-shaped structure.

4. The method of claim 1, wherein the disk-shaped structure has a higher volume resistivity than a volume resistivity of the electrical contact.

5. The method of claim 1, wherein the substantially cylindrical coil segment comprises a longitudinal axis, and the disk-shaped structure, the electrical contact, and the substantially cylindrical coil segment are joined such that an outer edge of the disk-shaped structure, an outer edge of the electrical contact, and an outer edge of the substantially cylindrical coil segment are disposed at a uniform radial distance from the longitudinal axis.

6. The method of claim 1, further comprising forming a recess in the coil segment.

7. The method of claim 6, wherein forming the recess produces a longitudinal protrusion extending from the end portion of the substantially cylindrical coil segment around a perimeter of the coil segment.

8. The method of claim 7, wherein the coil segment has an inner diameter and an outer diameter, the outer diameter being constant and the inner diameter increasing at the end portion.

9. The method of claim 6, wherein forming a recess in the coil comprises counterboring the recess in the coil segment.

10. The method of claim 6, wherein forming a recess in the coil comprises forging the recess in the coil segment.

11. The method of claim 1, wherein current flows along an outside diameter of the substantially cylindrical coil segment and an outside diameter of the electrical contact.

12. A method for making an electrode assembly for use in a vacuum interrupter, the method comprising:

forming an end portion at a perimeter of a substantially cylindrical coil segment;

joining a first side of a substantially disk-shaped structure to the end portion of a substantially cylindrical coil segment by contacting a contiguous surface at the end portion of the substantially cylindrical coil segment directly to the first side of the disk-shaped structure such that the first side of the disk-shaped structure is flush with the contiguous surface; and joining an electrical contact to a second side of the disk-shaped structure, such that, once joined, the electrical contact and the disk shape structure share an outer periphery and substantially all of a current that flows between the substantially cylindrical coil segment and the electrical contact flows through the end portion, wherein the disk-shaped structure has a higher volume resistivity than a volume resistivity of the electrical contact and the disk-shaped structure has a higher volume resistivity than a volume resistivity of the substantially cylindrical coil segment.

13. The method of claim 12, wherein the cylindrical coil segment is contacted at a radially outermost periphery of the first side of the disk-shaped structure.

14. The method of claim 12, wherein current flows along an outside diameter of the substantially cylindrical coil segment and an outside diameter of the electrical contact.

15. The method of claim 12, further comprising counterboring a recess in the coil segment.

16. A method for making an electrode assembly for use in a vacuum interrupter, the method comprising:

joining a first side of a substantially disk-shaped structure to an end portion of a substantially cylindrical coil segment, the disk-shaped structure having an outer diameter that is substantially equal to the outer diameter of the substantially cylindrical coil segment, the disk-shaped structure having a higher volume resistivity than a volume resistivity of the substantially cylindrical coil segment; and joining an electrical contact to a second side of the disk-shaped structure, the electrical contact having an outer diameter substantially equal to the outer diameters of the substantially cylindrical coil segment and the disk-shaped structure, such that substantially all current between the coil segment and the electrical contact travels through the end portion of the substantially cylindrical coil segment.

17. The method of claim 16, wherein the disk-shaped structure has a higher volume resistivity than a volume resistivity of the electrical contact.

18. The method of claim 16, further comprising forming a recess in the coil segment.

19. The method of claim 18, wherein forming the recess produces a longitudinal protrusion extending from the end portion of the substantially cylindrical coil segment around a perimeter of the coil segment.

20. The method of claim 18, wherein forming a recess in the coil comprises counterboring the recess in the coil segment.

* * * * *